US005493974A

United States Patent [19]

Bilgeri

[11] Patent Number: 5,493,974

[45] Date of Patent: Feb. 27, 1996

[54] SABOTED PROJECTILE WITH SUB-CALIBRE CORE PROJECTILE AND DISCARDING CAGE

[75] Inventor: Elmar Bilgeri, Steyr, Austria

[73] Assignee: Steyr-Daimler-Puch AG, Vienna, Austria

[21] Appl. No.: 182,018

[22] PCT Filed: Jul. 15, 1992

[86] PCT No.: PCT/AT92/00098

§ 371 Date: Jan. 18, 1994

§ 102(e) Date: Jan. 18, 1994

[87] PCT Pub. No.: WO93/02334

PCT Pub. Date: Feb. 4, 1993

[30] Foreign Application Priority Data

Jul. 17, 1991 [AT] Austria ..... 1436/91

[51] Int. Cl.[6] ..... F42B 14/06

[52] U.S. Cl. ..... 102/522

[58] Field of Search ..... 102/520–523, 102/532

[56] References Cited

U.S. PATENT DOCUMENTS

| | | | |
|---|---|---|---|
| 2,788,744 | 4/1957 | Donner | 102/523 |
| 4,709,638 | 12/1987 | Broden et al. . | |
| 4,850,280 | 4/1989 | Wallow et al. | 102/522 |

FOREIGN PATENT DOCUMENTS

| | | |
|---|---|---|
| 678906 | 9/1966 | Belgium . |
| 0336252 | 10/1989 | European Pat. Off. . |
| 2445509 | 7/1980 | France . |
| 2602042 | 1/1988 | France . |
| 1262830 | 3/1968 | Germany . |
| 57539 | 6/1970 | Luxembourg . |

*Primary Examiner*—Harold J. Tudor
*Attorney, Agent, or Firm*—Meltzer, Lippe, Goldstein et al.

[57] ABSTRACT

In the sub-calibre projectile proposed, the discarding cap (10) is made up of segments (11) whose bases (14) are secured between a pressure plate (15) and a pressure piece (18). In order to ensure that all the sabot segments (11) fall away reliably and precisely, the front end of each segment (11) has two surfaces (40, 41) inclined at an angle to each other in the shape of a roof to form a head (42).

8 Claims, 2 Drawing Sheets

SABOTED PROJECTILE WITH SUB-CALIBRE CORE PROJECTILE AND DISCARDING CAGE

Figure 1:
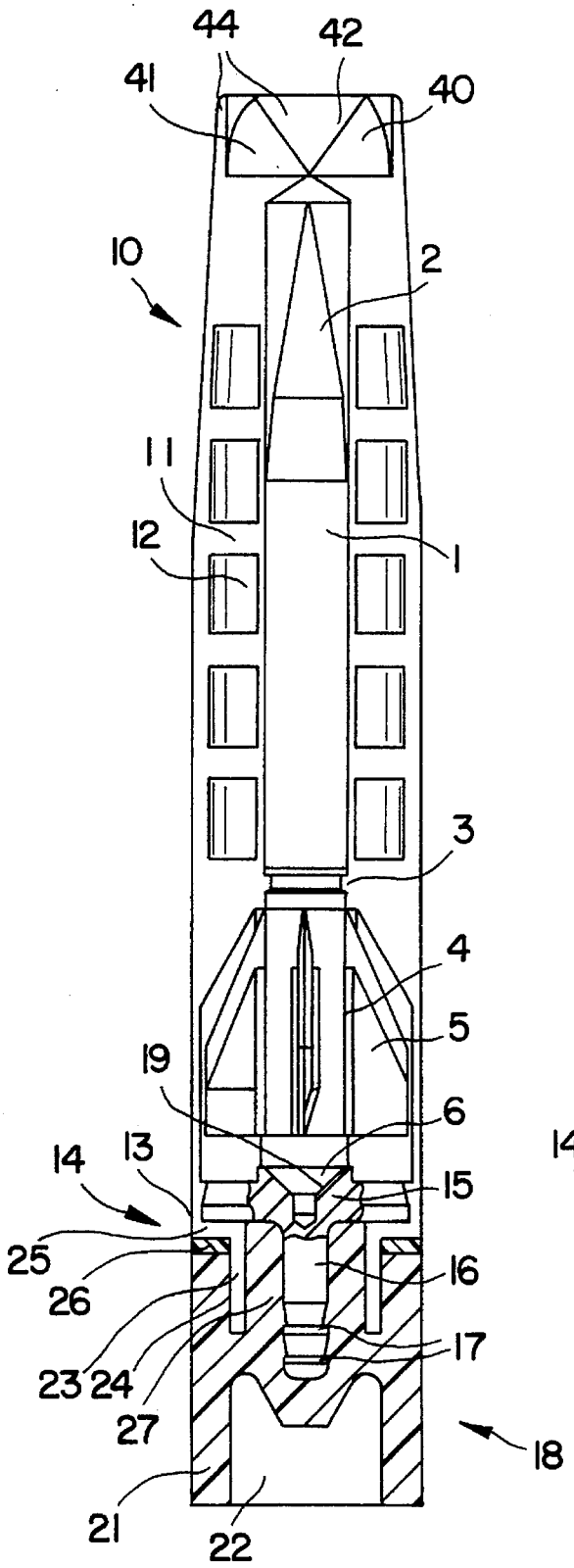

The invention relates to saboted projectiles comprising a sub-calibre core projectile and a discarding cage consisting of segments linked to bases by means of webs constituting breaking points, the bases being secured to a pusher means. Such projectiles can attain very high initial velocities and consequently a wide service range. This, however, makes target accuracy all the more important and special measures are required in order to safeguard against the pusher means or the discarding cage adversely affecting the projectile after leaving the barrel.

From the DE-B 1 262 830 for example, a sub-calibre projectile with discarding cage is known, which consists of segments torn away by aerodynamic forces when the projectile leaves the barrel. For the attack of the aerodynamic forces, a conical entry depression is provided in the front end of the cage and abreast with the projectile tip; the effect of the depression is that the impact pressure gives rise to forces in a radially outward direction leading to tearing apart of the segments.

Irrespective of whether the depression is cylindrical or conical, these radially outward forces are not sufficiently evenly distributed over the circumference to safeguard simultaneous tearing apart of the segments. The slightest unevenness, irrespective of whether tearing apart is restricted by breaking points or not, lead to a retroactive effect of the breakaway segments on the projectile, adversely affecting target accuracy.

With very fast projectiles there is the additional problem that the initial velocity approaches MACH-numbers of five or more, which means a hypersonic flow pattern. Hypersonic flow is, inter alia, characterized by leading edge shock waves lying close to the body surface, with the effect that no impact pressure occurs. As a result, the segments fail to come apart at all in extreme cases.

It is therefore an object of the present invention to eliminate retroactive effects of the breakaway segments on the projectile of highest initial velocity, in order to attain highest target accuracy. In particularly, the effect of the air flow should lead to simultaneous separation of the segments, with the segments enclosing equal angles between them during separation.

To this end, according to the invention, the front end of each segment has two surfaces inclined at an angle to each other forming a ridge in the plane of symmetry of the segment.

The roof-like configuration of the two symmetric surfaces assures an outwardly directed resultant aerodynamic force precisely in the plane of symmetry of the segments, even with hypersonic flow.

In a development of the invention, the ridge is inclined towards the rear in a radially inward direction. By variation of the angle between the projectile axis and the ridge, the outwardly directed component and the braking effect at the outset of opening can be optimized. An angle of approximately 45° has been established as favourable.

In a further development of the invention, the two surfaces are encircled on their outer circumference by a cylindrical wall. As a result, the rooflike surfaces are protected from damage during handling and loading of the projectile. Damaged ridges could (in particular with segments made from a plastic material) destroy the beneficial effect of the invention.

According to a further feature of the invention, the-segments extend beyond the tip of the core projectile, which they enclose between them. Thus, the tip of the core projectile is protected from damage and dirt and there is more space for the rooflike surfaces.

In a preferred embodiment of the invention, the pusher means impacts the rear end of the core projectile. This further diminishes the danger of the breakaway segments interfering with the core projectile and in case of a wing stabilized projectiles also diminishes the danger of damaging the wings.

According to a further feature of the preferred embodiment, the bases of the segments are secured in the pusher means between a pressure plate and a pressure piece. Holding the bases between the pressure piece and the pressure plate insures that separation occurs simultaneously and exactly at the breaking points. This has the further advantage that the pressure plate and the pressure piece are separate parts for which the material may be freely chosen and furthermore that the bases can be easily fitted.

According to a further feature of the invention, the pressure plate is provided with an alignment spike pressed into the pressure piece. As a result, very high forces can be passed on to the core projectile in an optimal way and the bases are held fast with great reliability, assuring that even when tearing off the segments no effect on the core projectile can occur.

Finally, it is within the scope of the present invention to design the segments so that they may be individually attached to the bases, without being linked to each other. This solid attachment of the segments to the bases and the high forces attainable at the tips of the segments by the particular disposition of the surfaces render it possible to make the breaking points strong enough to eliminate the need for links between the segments. This results in considerable economy of production and improves the fitting process of the individual segments.

Figure 2:
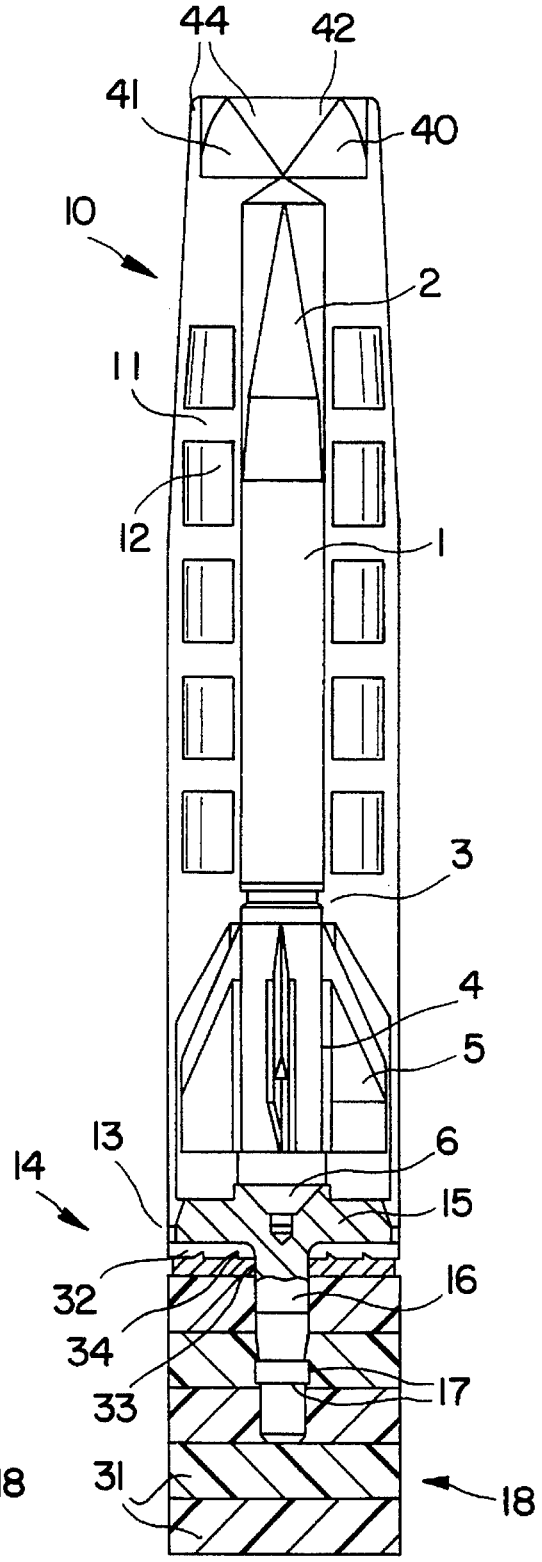
Figure 4:
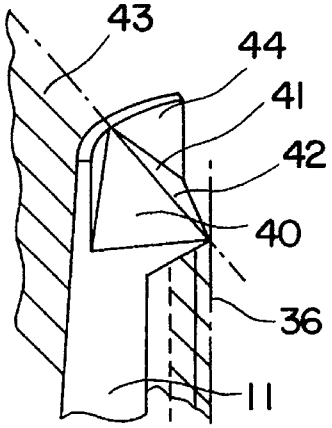
Figure 3:
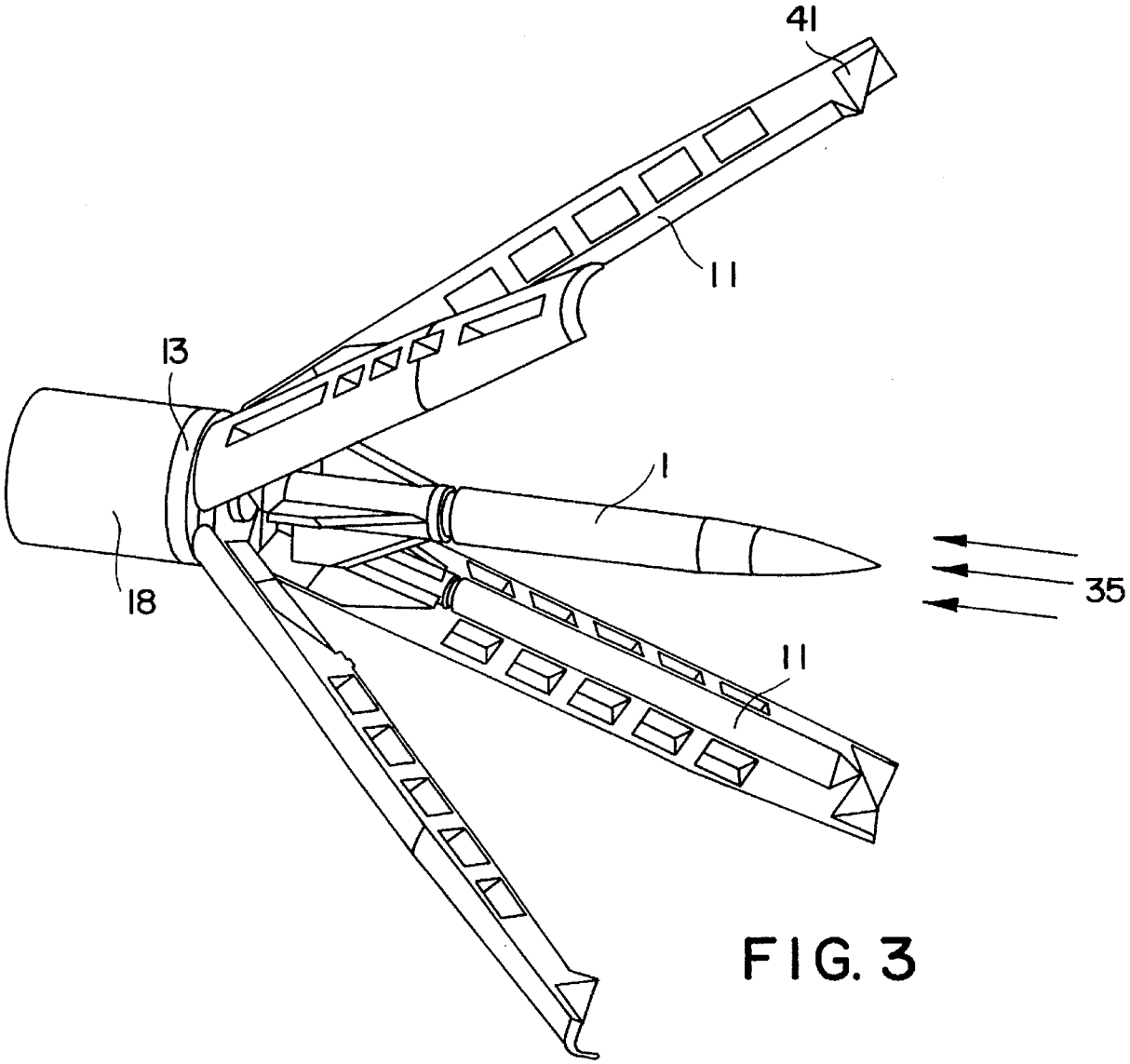

The present invention will be described more fully below, in conjunction with the following drawings:

FIG. 1 Longitudinal section through a projectile according to the invention in a first embodiment, FIG. 2 Longitudinal section through a projectile according to the invention in a second embodiment, FIG. 3 Projectile according to the invention during disintegration of the cage, FIG. 4 The guiding surfaces according to the invention, magnified.

In FIGS. 1 and 2, the projectile core of an arrow-projectile is designated with reference number 1 and it presents a tip 2, a circumferential recess 3 for positioning, a cylindrical part 4 for holding stabilizing wings 5 and a conical rear end 6. The projectile could also be of the spin stabilized type or just a projectile without wings.

The projectile 1 is surrounded by a cage 10 made from a suitable plastic material and consisting of segments 11, which can be either linked to each other or not and which can be provided with perforations or other shapes immaterial to the invention. The segments 11 are linked to bases 14 by webs 13 which constitute breaking points, the bases 14 being held between a pressure plate 15 from high-tensile steel or titanium and a pressure piece 18 in a manner yet to be described.

The pressure plate 15 is provided on its front side with a conical recess 19 for receiving the conical rear end 6 of the projectile and on its rear side with an alignment spike 16 with circumferential grooves 17 of a barbed profile. The pressure plate 15 is surrounded on its outer circumference by walls of the segments 11, very thin in the described embodiment in order to accommodate the stabilizing wings 5. Embodiments without such wings are also within the scope of the invention.

The front parts of the segments 11 extend beyond the tip 2 of the projectile, which they enclose between them. Furthermore, the front parts of the individual segments are provided with deflecting surfaces 40,41 whose shape considerably improves separation of the segments 11 after the projectile has left the barrel.

In the embodiment depicted in FIG. 1, the pressure piece 18 is made from a suitable plastic material and comprises a circumferential wall 21 whose lower part encloses a pusher cavity 22. Its upper part is provided with a cylindrical slot 23 for fastening the bases 14 of the segments 11. In the described embodiment, the segments are individual, but the cage could also be an integral part with breaking points. The segments 11 pass into a web 13 and further into a radially extending flange 25, followed by a collar 24, which is inserted into the cylindrical slot 23. The circumferential wall 21 is shortened on top in order to leave free space for the flange parts and for the mounting ring 26. The alignment spike 16 of the pressure plate 15 is pressed into the central part 27 of the pressure piece 18, thereby firmly holding the bases 14 between pressure plate 15 and pressure piece 18. In order to improve this hold, the alignment spike 16 is provided with circumferential grooves with barbed profile which facilitate pressing the spike into a bore of the central part 27 but impede pulling the spike out.

The plastic material for the pressure piece 18 is chosen so as to allow for a slight expansion of the circumferential wall 21 under the effect of the gas pressure exerted in the pusher cavity 22 for improved sealing with regard to the barrel while still being able to glide with low friction.

The mounting ring 26 facilitates assembly of the projectile when it consists of individual segments. The individual segments are positioned on the pressure plate 15 around the projectile core 2, which is seated on the pressure plate 15 and thereafter the mounting ring 26 is slipped onto the segments 11. In this manner, the individual segments 11 are held in place until the pressure piece 18 is pressed into the alignment spike 16 in order to hold the segments 11 in place.

In the embodiment according to FIG. 2, the pressure piece consists of individual disks 31 from a suitable plastic material, which are firmly joined to one another by ultrasonic or friction welding, thus forming a solid block with good sealing properties, plus low friction and strength. The alignment spike 16 of the pressure plate 15 is pressed into this pressure piece block 18. A further difference from the embodiment of FIG. 1 resides in the bases 14 of the segments 11 being only flanges 32, followed by a disk 33 with indentations 34. Disk 33 in this embodiment suffices for holding the flanges 32 and also acts as a mounting ring, as described above.

FIG. 3 shows the disintegrating cage for both embodiments of the invention after leaving the barrel. By the effect of the air flow 35, the segments are forced apart. It can be seen that the segments 11 (in this case four) are tilted away from the axis of the projectile by the same angle, and therefore rupture at the breaking points simultaneously. Due to the braking effect, the speed of the segments 11 diminishes before rupture at the breaking points, such that the pushing means and segments 11 stay behind the core projectile 1 without touching it.

FIG. 4 shows the tip of one segment 11 in more detail. Both surfaces 40,41 are inclined by the same angle and form a ridge 42. In the depicted example the surfaces are plane surfaces, but they could also be helicoid surface, depending on the manufacturing method selected. It is essential that the ridge 42 be in the plane of symmetry 43 of the segment 11, which plane also contains the axis 36 of the projectile 1. This insures that the air flow 35 gives rise to a resultant radial force in the plane of symmetry 43. This is essential in the case of segments linked to each other by breaking points, where the air flow generator pairs of circumferential forces, which cause the breaking points to rupture simultaneously. The cylindrical wall 44 is only effective with lower velocities, but in any case protects the delicate ridge 42 from damage.

I claim:

1. A saboted projectile comprising a sub-calibre core projectile (1) having a front end with a tip (2) and a rear end (6) on an axis (36), a discarding cage (10) surrounding said sub-calibre core projectile, said cage being opened by aerodynamic forces, said cage (10) further comprising segments (11) linked to bases (14) by means of webs (13) constituting breaking points, said bases (14) being secured to a pusher means (15, 16, 18, 31) wherein the front end of each said segment (11) has two surfaces (40, 41) inclined at an angle to each other in a roof-like shape, so as to form a ridge (42) in a plane of symmetry (43) of said segment (11), said plane of symmetry (43) also containing said axis (36) of said projectile (1).

2. The saboted projectile according to claim 1, wherein said ridge (42) is inclined towards the rear in a radially inward direction.

3. The saboted projectile according to claim 1, wherein said two surfaces (40, 41) are encircled on their outer circumference by a cylindrical wall (44).

4. The saboted projectile according to claim 1, wherein said segments (11) extend beyond and enclose said tip (2) of said core projectile (1).

5. The saboted projectile according to claim 1, wherein said pusher means (15, 16, 18, 31) impacts said rear end (6) of said core projectile (1).

6. The saboted projectile according to claim 5, wherein said bases (14) of said segments (11) are secured in said pusher means (15, 16 18, 31) between a pressure plate (15) and a pressure piece (18).

7. The saboted projectile according to claim 6, wherein said pressure plate (15) is provided with an alignment spike (17) which is pressed into said pressure piece (18).

8. The saboted projectile according to claim 1, wherein said segments (11) are individually attached to said bases (14).

* * * * *